United States Patent [19]

Hamer et al.

[11] Patent Number: 4,852,617

[45] Date of Patent: Aug. 1, 1989

[54] WEFT YARN STORE

[75] Inventors: Antonius Hamer, Eindhoven; Gerardus Spang, Deurne, both of Netherlands

[73] Assignee: Sulzer Brothers Limited, Winterthur, Switzerland

[21] Appl. No.: 176,944

[22] Filed: Apr. 4, 1988

[30] Foreign Application Priority Data

Apr. 8, 1987 [CH] Switzerland ..... 01347/87

[51] Int. Cl.[4] ..... D03D 47/34

[52] U.S. Cl. ..... 139/452; 139/370.2

[58] Field of Search ..... 139/452, 370.2; 242/47.01

[56] References Cited

U.S. PATENT DOCUMENTS

| | | | |
|---|---|---|---|
| 3,455,341 | 6/1969 | Pfarrwaller | 139/452 |
| 3,761,031 | 9/1973 | Pfarrwaller | 139/452 |
| 4,558,723 | 12/1985 | Tanaka et al. | 139/452 |
| 4,716,942 | 1/1988 | Jensen et al. | 139/370.2 |

*Primary Examiner*—Henry S. Jaudon

*Attorney, Agent, or Firm*—Kenyon & Kenyon

[57] ABSTRACT

The weft yarn leaving a drum of a weft yarn store of a loom is monitored by a monitor device disposed between the drum and a yarn eye in the zone of the yarn balloon. The monitor device includes a ring with an internal surface across which the yarn balloon slides during take-off. At least one light transmitter is mounted in the ring to emit a light beam across the path of the yarn and at least one transmitter is also mounted in the ring to receive the light beam for sensing when the yarn passes through the beam.

8 Claims, 4 Drawing Sheets

WEFT YARN STORE

This invention relates to a weft yarn store for a loom. More particularly, this invention relates to a yarn monitor device in a weft yarn store.

Heretofore, various types of weft yarn stores have been known which employ yarn monitor devices for monitoring the operation of the stores. For example, European patent application No. 0,111,308, describes two kinds of turn counters for the weft yarn departing from a storage drum. In one kind, for example, a photo transmitter is disposed near the storage drum and a transmitter beam is reflected from the drum periphery and to a receiver disposed near the transmitter. Whenever the weft yarn cuts the light beam while being drawn off the drum, a signal, for example, corresponding to one drawn-off turn, is transmitted to the weft yarn store control. The same application also describes an arrangement of an optical sensor for the weft yarn in a cylindrical eye between the drum and a picking device—an air jet nozzle in the case under consideration. Inside the eye, a member which is symmetrical in rotation is disposed on the eye axis and cooperates with the eye to bound an annular chamber in which the weft yarn rotates as the yarn is being drawn off the drum.

Both kinds of weft yarn monitors suffer from the disadvantage that the weft yarn can take up any position in the gap between the sensor and the drum in the first case and the rotationally symmetrical member in the second case. The distance between the weft yarn and the surface via which the light beams issue from the monitor may vary in accordance with the internal width of the gap in this zone. Deposits may therefore stick to the exit surface and not be scraped away regularly by the weft yarn during passage thereby. Deposits of this kind, for example, in the form of particles of yarn, may disturb the beam path from the transmitter to the receiver and trigger fault signals which may interrupt weaving. Interruptions of this kind are unwanted since they impair loom efficiency.

Accordingly, it is an object of the invention to provide a weft yarn store with a monitor device which can be cleaned reliably and automatically by the weft yarn.

It is another object of the invention to increase the working life of a weft yarn monitor device in a weft yarn store.

It is another object of the invention to provide a yarn monitor which is reliable in operation.

Briefly, the invention provides a weft yarn store having a stationary drum for receiving a plurality of yarn windings, a yarn eye spaced from the drum for guiding a yarn axially from the drum and a monitor device disposed between the drum and eye in a zone where a yarn balloon forms between the drum and eye. The monitor device includes a ring having an internal surface for circumferential sliding of the yarn balloon thereon, at least one transmitter in the ring for directing a light beam across the path of the yarn balloon and at least one receiver in the ring for receiving the light beam.

Preferably, the transmitter and receiver in the ring are disposed in pockets closed off from the inner boundary surface of the ring. In this event, the monitoring ring must be made of a transparent material, such as Plexiglass, so that the light beams from the transmitter or receiver in a pocket can pass without hindrance through the ring material as far as the inner boundary surface of the ring. Advantageously, at least one sensor pair in the form of a photo transmitter and a photoreceiver is so disposed in the monitor ring that the light beams from the transmitter to the receiver form a chord in a circle disposed in the inner boundary surface of the ring. The radiation axes of the transmitter and receiver form with the chord the angle at which the light is refracted in its passage through the inner boundary surface.

In another embodiment, a reflecting projection or cone is disposed inside the ring on the drum and the transmitter and receiver are disposed one beside another so that the light beams from the transmitter, after passing through the inner boundary surface of the ring, are reflected by the projection to the receiver. For inter-monitoring of the sensors, a number of sensors each comprising a transmitter and a receiver can be present in the ring.

If the ring is made of an opaque material, the sensors are disposed in bores in the ring, the bores being open towards the inside thereof. Since the weft yarn grazes the inside of the ring while being drawn off the drum, so that the yarn balloon is limited, the ring deflects the weft yarn. If the ring is made of a soft material, the yarn-deflecting ring edge is protected against wear by an annular insert made of a hard material.

The monitor device obviates soiling of the surface through which the light beams between the transmitter and receiver must pass, thus increasing the reliability of operation of the monitor device and, therefore, of the entire loom.

These and other objects and advantages of the invention will become more apparent from the following detailed description taken in conjunction with the accompanying drawings wherein FIG. 1 illustrates a schematic overview of a weft yarn store for a loom according to the invention;

Figure 1:
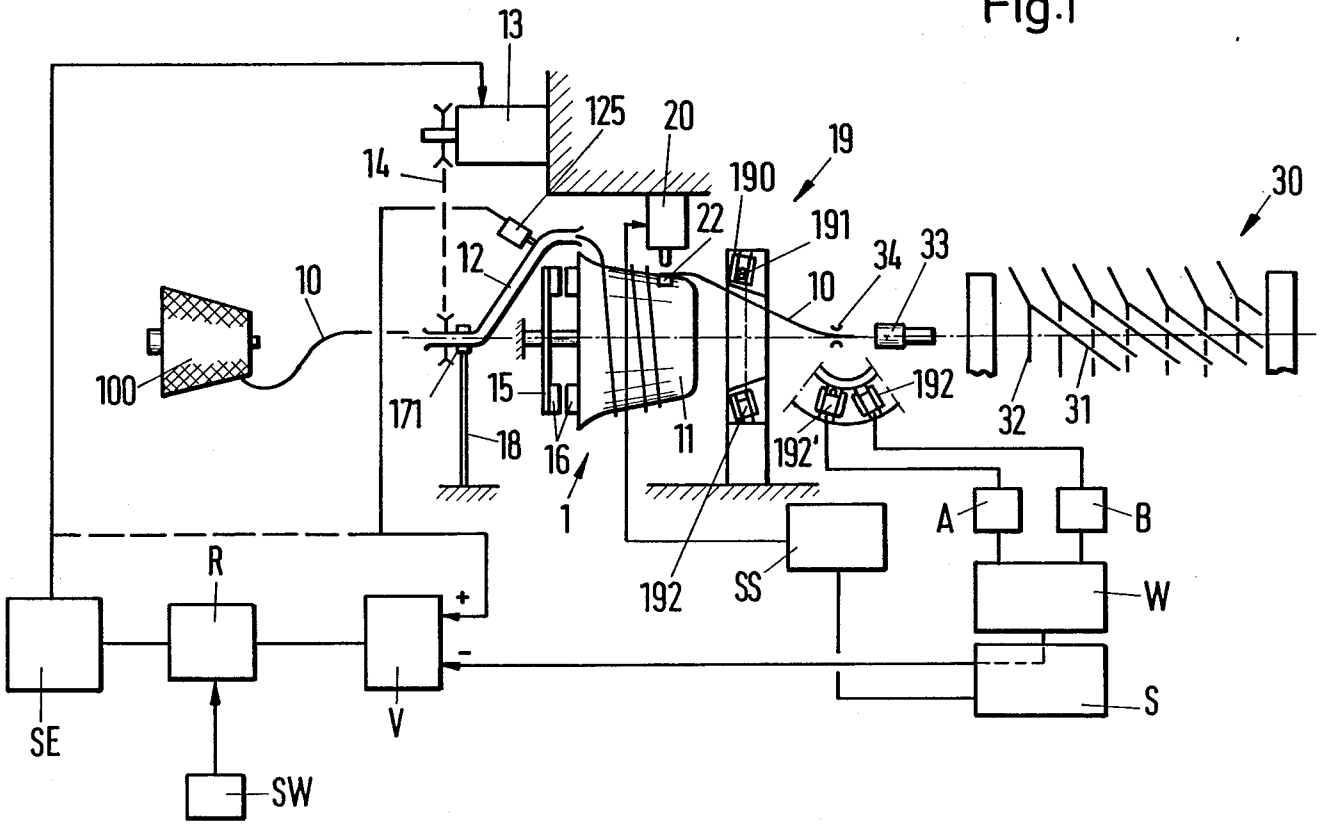

Referring to FIG. 1, a weft yarn 10 to be processed in a loom 30 is drawn off a yarn package 100 by a weft yarn store 1 and subsequently delivered to the loom 30. As indicated, the weft yarn store 1 includes a winder 12 for winding the weft yarn in a plurality of windings onto a stationary drum 11. In addition, an eye 34 is spaced from the drum 11 for guiding the yarn 10 axially from the drum 11 into an air jet nozzle 33 for picking the weft yarn 10 into a shed formed by warp yarns 31, 32 in the loom 30. A monitor device 19 is also disposed between the drum 11 and the eye 34 in a zone where a yarn balloon forms.

Figure 2:
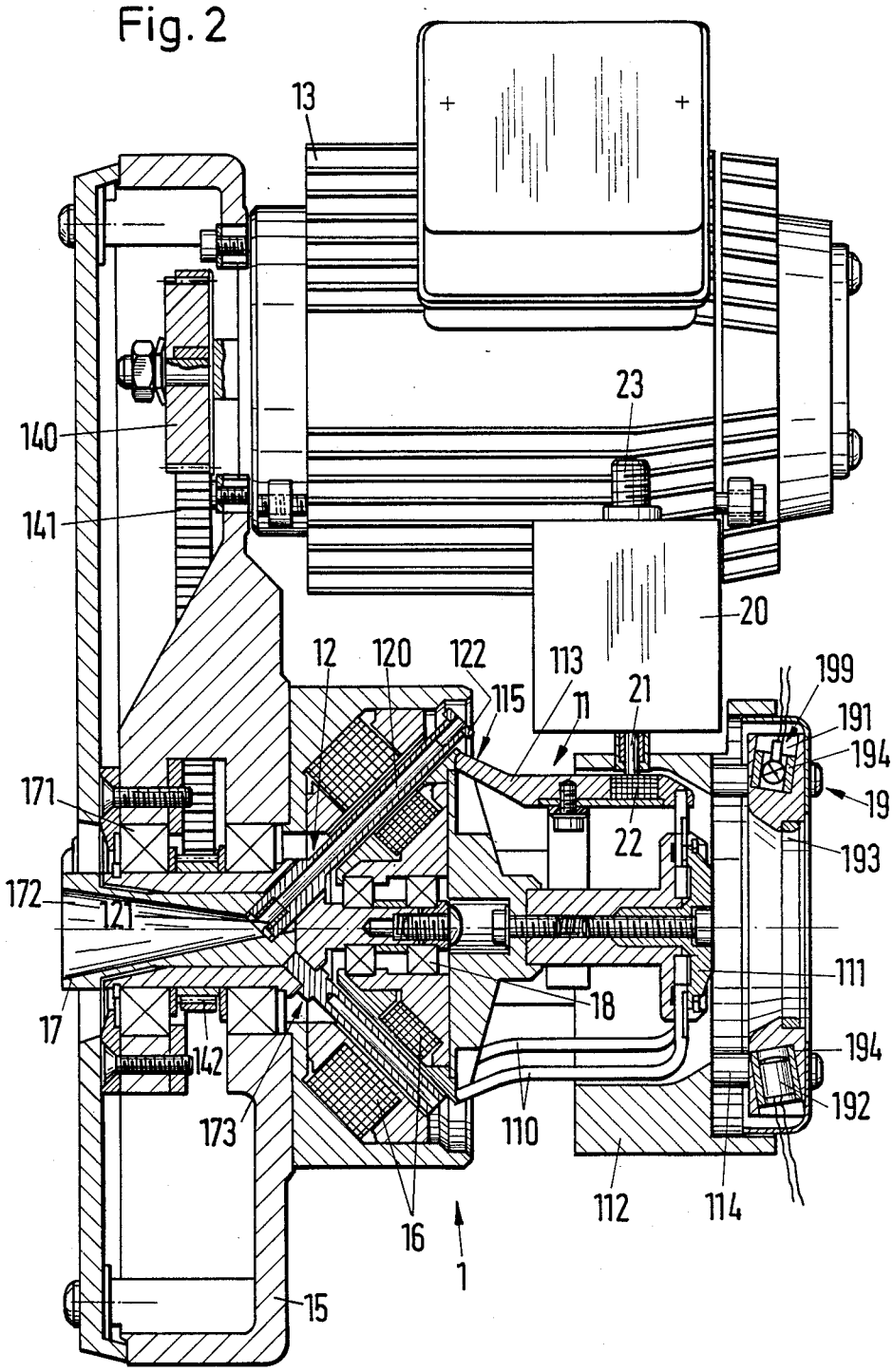
FIG. 2 illustrates a part cross-sectional view of the yarn store of FIG. 1.

Referring to FIG. 2, the weft yarn store 1 includes a funnel 172 within a winder shaft 17 through which the weft yarn enters prior to passage into the winder 12. The winder 12 which is shown schematically in FIG. 1 is formed of a tube 120 having eyes 121, 122 at opposite ends. This tube 120 is secured in the shaft 17 in known manner. In addition, a rod 173 which functions as a counterweight is disposed diametrically opposite the winder tube 120.

The winder shaft 17 is mounted via bearings 171 in a casing 15 and is driven by a controlled electric motor 13 by way of a drive 14, such as a belt drive 140, 141, 142. The drum 11 is mounted via radial bearings 18 on the winder shaft 17 and is prevented from rotating with the shaft 17 by magnet pairs 16. One magnet of each pair is disposed in the casing 15 and the other magnet is disposed in the drum 11.

An envelope 113 extends over only some of the periphery of the drum 11 while the remainder of the drum 11 is formed by stirrups 110 having bent ends which converge radially at a flange 111. The flange 111 is, in turn, operative to retain the stirrups 110 and facilitates radial adjustment of the stirrups 110 so that the periphery of the drum can be varied in accordance with the weft yarn length required in the loom 30. After the weft yarn has been deposited on a conical part 115 of the drum 11, the windings of weft yarn slide to the right, as viewed in FIG. 2 onto the cylindrical part of the drum 11 for intermittent withdrawal therefrom.

The construction of the drum is generally conventional and need not be further described.

Referring to FIG. 1, the weft yarn store includes an electromagnetic yarn clamp 20 which cooperates with the drum 11 in order to retain the weft yarn 10 thereon after picking. As indicated, the weft yarn clamp 20 is in the form of an electromagnet which is disposed opposite an abutment surface 22 of the drum 11 for retaining the weft yarn thereat.

Referring to FIG. 2, wherein like reference characters indicate like parts as above, the electromagnet 20 has a locking pin 21 which is reciprocably mounted to engage against the abutment surface 22 of the drum 11.

The beginning and termination of drawing-off of the yarn are controlled by the locking pin 21 which the electromagnet 20 can move radially onto the abutment surface 22 in the drum 11. As indicated in FIG. 2, the magnet 20 has a connecting boss 23 for compressed air operative to cool and damp the magnet armature.

A cap 112 engages around the draw-off end of the drum 11 and co-operates therewith to bound a narrow annular gap for braking the turns of yarn leaving the store 1.

The monitor device 19 includes a monitor ring 190 which is secured by pins 114 to the cap 112 which serve as means for moving the ring 190 axially of the drum 11 in order to vary the braking of the departing weft yarn 10. The ring 190 is made of a transparent material, such as Plexiglass, and has a conical internal surface for circumferential sliding of the yarn balloon therein in order to limit the balloon of departing weft yarn. The exit edge of the ring 190 is protected by a wearing or replacement ring 193 made, for example, of hardened steel or of ceramic. In addition, the device 19 includes a pair of sensors mounted in the ring 190.

Figure 3:
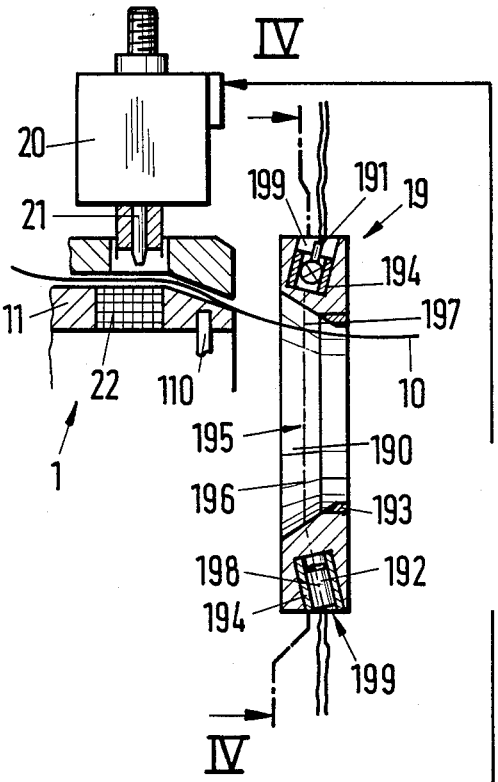
FIG. 3 illustrates a part cross-sectional view of a monitor device in accordance with the invention.
Figure 4:
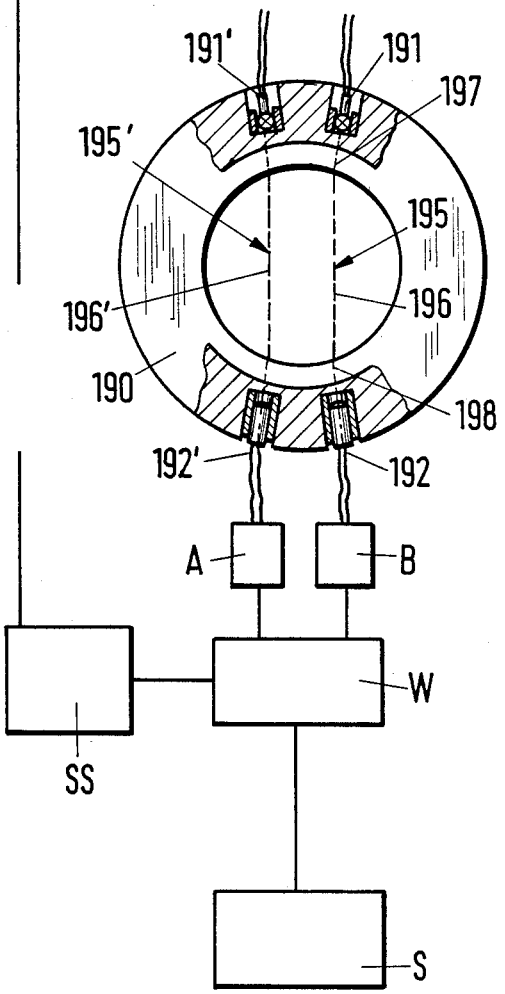
FIG. 4 illustrates an end view of the monitor device.

Referring to FIGS. 2 and 3, the sensors are circumferentially spaced about the ring 190 and about the opening through which the weft yarn is drawn-off the drum 11. Each sensor includes a transmitter 191, 191' which is mounted in a pocket of the ring 190 and co-operates with a receiver 192, 192' which is mounted in a pocket of the ring 190 to form a light beam or barrier 195, 195' as a chord 195, 195' across the ring 190 as shown in FIG. 4. Since the beam path 195, 195' is interrupted at the passage of the beams into the ring interior or out of the ring 190, each transmitter 191 and receiver 192 must be disposed in accordance with the angles of refraction of the beams. Thus, the radiation axes 197, 198 of the transmitter 191 and receiver 192 are each disposed at an angle to the chord 195 equal to the angle of refraction of light from the internal surface of the ring 190.

As indicated in FIG. 2, a jacket 194 extends around the transmitters 191, 191' and receivers 192, 192'.

The passage of the weft yarn 10 from the drum 11 is sensed by the yarn 10 briefly interrupting the beam paths 195, 195' (see FIG. 3). The receivers 192, 192' then emit signals in response and these signals are transmitted to amplifiers A and B, respectively (see FIG. 4). An evaluating unit W shown in FIG. 4 compares the sequence of the signals in time from the amplifiers A, B with an expected model. FIG. 5*a* shows the expected signal sequence model for the case in which there is a dual arrangement of transmitters 191 and receivers 192. At each revolution of the weft yarn in the ring 190, the beam path 195, 195' is interrupted twice, leading to the formation and propagation of two rectangular pulses in time sequence at the evaluating unit W. If the monitor device is operating correctly, the unit W transmits a control signal to a control SS for the magnet 20 FIG. 2 when a predetermined number of regular pulses have been recorded in the unit W.

After the required number of turns of yarn have been drawn off the drum 11, the magnet 20 presses the pin 21 onto the abutment surface 22 to terminate the drawing-off of the yarn 10 from the drum 11.

Figure 5:
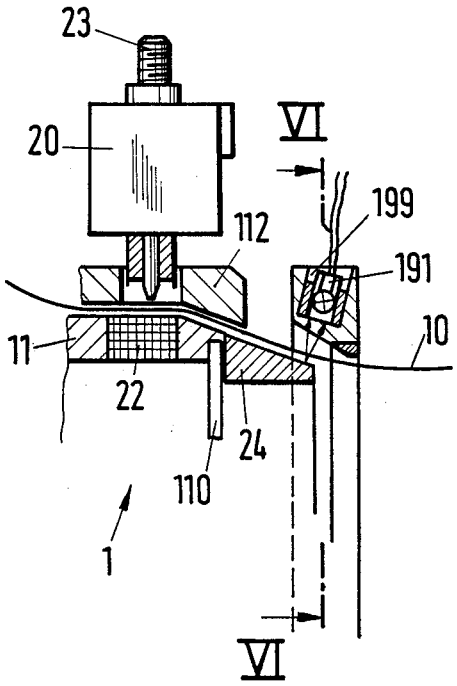
FIG. 5 illustrates a part cross-sectional view of a modified monitor device according to the invention.
Figure 6:
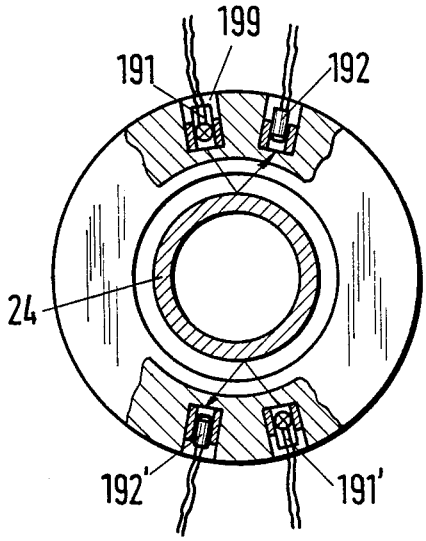
FIG. 6 illustrates an end view of the monitor device of FIG. 5.

Referring to FIGS. 5 and 6, wherein like reference characters indicate like parts as above, the monitor device may include an annular reflector cone 24 mounted on the drum 11 of the store to reflect the light beam of each transmitter 191, 191' to a receiver 192, 192', respectively disposed adjacent the transmitter. In this device, only one signal at a time is received alternately in the amplifiers A and B (not shown), as indicated in FIG. 8*a*, during the drawing-off of weft yarn from the drum 11.

FIG. 1 illustrates the control of the electric motor 13 for the weft yarn winder 12. The function of the motor 13 is so to drive the winder 12 by way of a belt drive 14 so that the number of windings of yarn drawn off the drum 11 are immediately replaced by fresh yarn being wound on from the package 100 to ensure that yarn windings are always present on the drum 11 in sufficient quantity. The number of yarn turns actually drawn off is continuously reported by the evaluating unit W to a comparator V which, by way of a sensor 125 and a report-back from the control SE for the electric motor 13, records the number of freshly deposited yarn windings. The difference between freshly deposited yarn windings and drawnoff yarn windings is transmitted by the comparator V to a controller R which compares the difference from the comparator V with the set value of an input device SW and delivers control instructions accordingly to the electric motor control SE.

The invention thus provides a monitor device of simple and reliable construction which can be cleaned by the yarn being monitored, thus reducing the risk of disturbances in operation due to soiling.

The invention further provides a monitoring procedure whereby malfunctioning of a loom due to excessive or insufficient lengths of picked weft yarns is reduced and the operating life of a loom extended.

What is claimed is:

1. A weft yarn store comprising a stationary drum for receiving a plurality of yarn windings;

a yarn eye spaced from said drum for guiding a yarn axially from said drum; and a monitor device disposed between said drum and said eye in a zone where a yarn balloon forms between said drum and said eye, said monitor device including a ring having an internal surface for circumferential sliding of the yarn balloon thereon, at least one transmitter in said ring for directing a light beam across the path of the yarn balloon during sliding of the yarn balloon on said internal surface and at least one receiver in said ring for receiving said light beam.

2. A weft yarn store as set forth in claim 1 wherein said ring is transparent and includes at least two pockets closed off from said internal surface and receiving said transmitter and said receiver respectively therein.

3. A weft yarn store as set forth in claim 1 wherein said transmitter directs said light beam as a chord across said ring to said receiver.

4. A weft yarn store as set forth in claim 3 wherein said transmitter directs said light beam on a radiation axis disposed at an angle to said chord equal to the angle of refraction of light from said internal surface and said receiver receives said light beam on a radiation axis disposed at an angle to said chord equal to mid angle of refraction.

5. A weft yarn store is set forth in claim 1 which further comprises an annular reflector cone concentrically within said ring and wherein said receiver is positioned relative to said transmitter to receive said light beam after being reflected from said cone.

6. A weft yarn store as set forth in claim 1 which comprises at least two of said transmitter and said receiver disposed in pairs on said ring.

7. A weft yarn store as set forth in claim 1 further comprising a replaceable ring of hard material mounted on and within an annular edge of said internal surface of said ring.

8. A weft yarn store as set forth in claim 1 further comprising means for moving said ring axially of said drum.

* * * * *